United States Patent [19]

Kawakami et al.

[11] Patent Number: 4,982,025

[45] Date of Patent: Jan. 1, 1991

[54] ELECTRICAL INSULATING OIL COMPRISING IMPROVED FRACTION

[75] Inventors: Shigenobu Kawakami, Ichikawa; Keiji Endo, Yokosuka; Hideyuki Dohi, Yokohama; Atsushi Sato, Tokyo, all of Japan

[73] Assignee: Nippon Petrochemicals Company, Limited, Tokyo, Japan

[21] Appl. No.: 321,158

[22] Filed: Mar. 8, 1989

[30] Foreign Application Priority Data

Mar. 9, 1988 [JP] Japan ..... 63-55149

[51] Int. Cl.[5] ..... H01B 3/22

[52] U.S. Cl. ..... 585/6.3; 585/25; 585/475; 361/315

[58] Field of Search ..... 585/6.3, 475, 25; 361/315

[56] References Cited

U.S. PATENT DOCUMENTS

| | | | |
|---|---|---|---|
| Re. 29,857 | 12/1978 | Argauer . | |
| 2,282,327 | 5/1942 | Driesback | 260/668 |
| 2,308,415 | 1/1943 | Driesback . | |
| 3,702,886 | 11/1972 | Argauer | 423/328 |
| 3,714,021 | 1/1973 | Takahashi et al. | 208/232 |
| 3,753,188 | 8/1973 | Miyoshi et al. | 340/14 |
| 3,758,403 | 9/1973 | Rosinski | 208/120 |
| 3,786,107 | 1/1974 | Kuribayashi et al. | 260/672 T |
| 3,790,471 | 2/1974 | Argauer . | |
| 3,796,934 | 3/1974 | Munch | 317/259 |
| 3,926,782 | 12/1975 | Plank | 208/135 |
| 3,965,209 | 6/1976 | Butter | 260/671 |
| 4,011,274 | 3/1987 | Watanabe et al. | 260/668 |
| 4,035,285 | 7/1977 | Owen | 208/120 |
| 4,111,825 | 9/1978 | Schulz et al. | 252/63 |
| 4,117,026 | 9/1978 | Haag | 260/671 |
| 4,228,024 | 10/1980 | Schulz et al. | 252/63 |
| 4,365,103 | 12/1982 | Chang et al. | 585/320 |
| 4,454,364 | 6/1984 | Farcasiu et al. | 585/470 |
| 4,463,209 | 7/1984 | Kursewicz et al. | 585/467 |
| 4,480,144 | 10/1984 | Smith | 585/481 |
| 4,523,044 | 6/1985 | Commandeur et al. | 585/11 |
| 4,665,253 | 5/1987 | Chu et al. | 585/475 |
| 4,686,548 | 8/1987 | Takahashi et al. | 503/225 |

FOREIGN PATENT DOCUMENTS

| | | | |
|---|---|---|---|
| 226152 | 6/1987 | European Pat. Off. . | |
| 3127905 | 2/1983 | Fed. Rep. of Germany | 585/6.3 |
| 56-16532 | 2/1981 | Japan . | |
| 62-55863 | 3/1987 | Japan . | |
| 1463359 | 2/1977 | United Kingdom . | |
| 1574523 | 9/1980 | United Kingdom . | |

OTHER PUBLICATIONS

Asakura et al., "Friedel–Crafts Isomerization of Phenyltolymethane and Ditolylmethane by Aluminum Chloride," Kinki Daigaku Kogakubu Kenkyu Hokoku, 1984, 18, 49–54 (CA 105: 78573v).

Chem. Abstract No. 107: 236220a, p. 740 (1987).

Chen et al., "Industrial Application of Shape Selective Catalysis".

Catal. Rev.-Sci, Eng., 28 (2&3), pp. 185–264 (1986).

*Primary Examiner*—Curtis R. Davis

*Attorney, Agent, or Firm*—Fisher, Christen & Sabol

[57] ABSTRACT

An electrical insulating oil mainly comprising a fraction having excellent low temperature characteristics, said fraction being prepared by bringing a by-product oil fraction containing diphenylmethane and 1,1-diphenylethane into contact with alkylbenzenes in the presence of a ZSM-5 type synthetic zeolite catalyst, then recovering a fraction containing 1,1-diphenylethane and other diarylalkanes and containing mainly components having boiling points in the range of 270° to 300° C. as atomspheric pressure basis, said by-product oil fraction being by-produced in the preparation of ethylbenzene by alkylating benzene with ethylene.

11 Claims, No Drawings

ELECTRICAL INSULATING OIL COMPRISING IMPROVED FRACTION

BACKGROUND OF THE INVENTION (1) Field of the Invention

This invention relates to an electrical insulating oil which comprises an improved recovered fraction.

More particularly, the invention relates to an electrical insulating oil comprising a by-product oil fraction having excellent low temperature characteristics, which fraction is prepared by bringing a by-product oil fraction into contact with alkylbenzenes in the presence of ZSM-5 type synthetic zeolite catalyst.

(2) Description of Prior Art

It has been industrially put to practice to alkylate benzene with ethylene in the presence of an alkylation catalyst so as to produce ethylbenzene. The obtained ethylbenzene is then dehydrogenated into styrene, which is widely used as a raw material for producing polystyrene and other chemical substances.

When ethylbenzene is produced, a heavier oil fraction containing diarylalkanes is formed by side reaction. For example, it is disclosed in U.S. Pat. No. 4,111,824 that the heavier oil fraction which is obtained by using aluminum chloride as an alkylation catalyst, can be used as an electrical insulating oil. The the heavier oil fraction contains diarylalkanes typically exemplified by diphenylmethane and 1,1-diphenylethane. Because these diarylalkanes have high aromaticity, the fraction is in itself desirable as an electrical insulating oil, especially for the use as a capacitor oil.

Nevertheless, because the freezing point of diphenylmethane among them is high, it is not suitable for the use as electrical insulating oil when good low temperature characteristics are required. However, even when 1,1-diphenylethane itself is recovered singly, it is not always suitable either for the use in the field of electrical insulating oil in which low temperature characteristics are required.

In addition, when diphenylmethane and 1,1-diphenylethane are recovered by separating them through distillation, rectifying towers having considerably large theoretical number of plates are necessary.

Therefore, in the case that desirable components as electrical insulating oils, especially those being advantageous in low temperature characteristics, are recovered from the above by-product oil fraction, even if the undesirable diphenylmethane could be removed by the difficult operation of distillation, it is difficult to recover an electrical insulating oil having good low temperature characteristics.

BRIEF SUMMARY OF THE INVENTION

It is, therefore, the primary object of the present invention to recover economically an electrical insulating oil which has a low freezing point from the by-product oil fraction in ethylbenzene preparation.

That is, the present invention relates to an electrical insulating oil which mainly comprises a fraction having excellent low temperature characteristics, said fraction being prepared by bringing a by-product oil fraction containing diphenylmethane and 1,1-diphenylethane into contact with alkylbenzenes having at least one alkyl group of 1 to 4 carbon atoms in the presence of a ZSM-5 type synthetic zeolite catalyst at a reaction temperature in the range of 180° to 400° C. in liquid phase, then recovering from the treated mixture a fraction containing 1,1-diphenylethane and other diarylalkanes and containing mainly components having boiling points in the range of 270° to 300° C. as atmospheric pressure basis, said by-product oil fraction being by-produced in the preparation of ethylbenzene by alkylating benzene with ethylene in the presence of a synthetic zeolite catalyst.

DETAILED DESCRIPTION OF THE INVENTION

In the following, the present invention will be described in more detail.

In the preparation of ethylbenzene, benzene is alkylated with ethylene in the presence of an alkylation catalyst to obtain an alkylation product mainly containing unreacted benzene, ethylbenzene, polyethylbenzene and heavier side reaction products. This alkylation can be carried out by known methods of liquid phase alkylation or gas phase alkylation. The molar ratio of benzene to ethylene is in the range from about 25:1 to 1:5, preferably from about 10:1 to 1:1.

Generally, the gas phase alkylation is employed. In this method, for example, a material to be alkylated is reacted by being passed through a ZSM-type synthetic zeolite catalyst at a temperature in the range of about 250° to 650° C., preferably about 300° to 550° C., at a pressure in the range of atmospheric pressure to 100 $kg/cm^2$, preferably from atmospheric pressure to 70 $kg/cm^2$, and at a space velocity in WHSV in the range of 1 to 500, preferably 1 to 300. The ZSM-5 type synthetic zeolite as the alkylation catalyst in the ethylbenzene preparation is basically the same as the so-called ZSM-5 type zeolite which will be described later in more detail.

As a result of the alkylation, an alkylation product mainly containing unreacted benzene, ethylbenzene, polyethylbenzene and heavier reaction products, is obtained. If necessary, the catalyst can be removed previously.

The by-product oil is recovered from the thus obtained alkylation product by removing unreacted benzene, ethylbenzene and at least a part of polyethylbenzene.

The starting oil material used in the present invention is a by-product oil which contains diphenylmethane and 1,1-diphenylethane. This by-product oil is recovered directly from the alkylation product by distillation, usually by reduced pressure distillation. Otherwise, the by-product oil containing the aimed diphenylmethane and 1,1-diphenylethane can be obtained by firstly recovering a fraction having a wide boiling range and then by distilling it again. Anyway, it is inevitable that the starting material used in the present invention contains diphenylmethane and 1,1-diphenylethane. In other words, prior to the reaction in the present invention, it is not necessary to increase the content of 1,1-diphenylethane in the starting by-product oil by previously eliminating diphenylmethane by means of very fine rectification which is difficult in operation. Meanwhile, when 1,1-diphenylethane is contained too much in the by-product oil, the yield of the aimed fraction is undesirably lowered. Accordingly, the content of 1,1-diphenylethane in the starting by-product oil may be up to 50% by weight relative to the quantity of diphenylmethane.

In the next step, alkylbenzene is added to the above described starting fraction. The alkylbenzenes to be brought into contact have at least an alkyl group of 1 to 4 carbon atoms. These alkyl groups are exemplified by methyl, ethyl, propyl, isopropyl, n-butyl, isobutyl, sec-butyl and tert-butyl. The alkylbenzenes used in the present invention can be provided with 1 to 4 of these alkyl groups. More particularly, the alkylbenzenes are exemplified by toluene, ethylbenzene and xylene. Among them, toluene is preferable. These alkylbenzenes can be used either singly or in combination of two or more.

The reaction according to the present invention is carried out at a reaction temperature of 180° to 400° C., preferably 200° to 350° C. in the presence of a ZSM-5 type synthetic zeolite catalyst. If the reaction temperature is lower than 180° C., it does not fit for practice because the reaction cannot proceed substantially. On the other hand, when the reaction temperature is higher than 400° C., it is not desirable either because side reaction may be caused to occur.

The synthetic zeolite catalyst which is used in the reaction with alkylbenzene is basically the same ZSM-5 type synthetic zeolite catalyst as the alkylation catalyst used in the preparation of ethylbenzene. The catalyst will be described in more detail.

The catalyst used in the reaction with alkylbenzene is a crystalline synthetic aluminosilicate zeolite of 20 or higher in molar ratio of $SiO_2/Al_2O_3$ and the inlets of main pores thereof are composed of ten-membered oxygen rings. Such a zeolite is exemplified by ZSM-5 type synthetic zeolite having the inlets of main pores composed of ten-membered oxygen rings as well as zeolite zeta 1 and zeolite zeta 2. That is, the zeolite used in the present invention is characterized in that the inlets of main pores are composed of ten-membered oxygen rings. Conventional synthetic zeolites such as Linde A and erionite have eight-membered oxygen rings. Meanwhile, mordenite, Linde X and zeolite Y have twelve-membered oxygen rings.

These conventional zeolites having eight-membered oxygen rings or twelve-membered oxygen rings are not suitable for use in the method of the present invention because the structure of them are different from that of the catalyst used in the present invention.

Any of crystalline synthetic aluminosilicates as far as they are 20 or higher in molar ratio of $SiO_2/Al_2O_3$ and the inlets of main pores thereof are composed of ten-membered oxygen rings, can be used as the crystalline synthetic zeolite in the present invention. Especially preferable ones are ZSM-5 type synthetic zeolites known as ZSM-5, ZSM-11, ZSM-22, ZSM-23, ZSM-35, ZSM-38 and ZSM-48. These ZSM-5 type synthetic zeolites have the structural characteristic that the inlets of main pores are composed of ten-membered oxygen rings. Furthermore, especially preferable synthetic zeolite is ZSM-5. The compositions and methods for preparing these ZSM-5 type zeolites are disclosed in the following patent gazettes.

ZSM-5: U.S. Pat. No. 3,702,886

ZSM-11: U.S. Pat. No. 3,709,979 and Japanese Patent Pub. No. 53-23280

ZSM-22: U.S. Pat. No. 4,481,177

ZSM-23: U.S. Pat. No. 4,076,842 U.S. Pat. No. 4,490,342

ZSM-35: Japanese Laid-Open Patent Publication No. 53-144500

ZSM-38: U.S. Pat. No. 4,046,859

ZSM-48: U.S. Pat. No. 4,423,021

Zeolite Zeta 1: Japanese Laid-Open Patent Publication No. 51-67299

Zeolite Zeta 2: Japanese Laid-Open Patent Publication No. 51-67298

The synthetic zeolite having the structural characteristic that the inlets of main pores are composed of ten-membered oxygen rings, has usually a high molar ratio of $SiO_2/Al_2O_3$ and the value is generally 20 or higher. In some case, the molar ratio of $SiO_2/Al_2O_3$ is very high, for example, the synthetic zeolite having a molar ratio as high as 1600 can be effective. Furthermore, in some case, it is possible to use a zeolite having a value close to infinity in the molar ratio of $SiO_2/Al_2O_3$. Such a "high-silica" zeolite is also included in the definition of the present invention. This molar ratio of $SiO_2/Al_2O_3$ can be determined by an ordinary analytical method such as atomic absorption spectrum analysis. This ratio is represented as close as possible to the ratio in the hard skeleton of zeolite crystal but the aluminum in cation form or other forms contained in binder or channels is excluded.

The structure of ten-membered rings in the inlets of main pores usually confirmed by X-ray diffractiometry. For example, the ZSM-5 type synthetic zeolites which are suitably used as catalysts in the present invention exhibit characteristic X-ray diffraction patterns particular to them (cf: the foregoing patent gazettes in detail).

It is, however, possible to use values of constraint indexes in place of the X-ray diffractiometry. That is, the ten-membered oxygen ring in the present invention can be defined as the zeolite having constraint indexes of 1 to 12. By the way, the practical determination method of the constraint index is described in Japanese Laid-Open Patent Publication No. 56-133223. This index shows the degree that the fine pore structure of zeolite crystal restrains the access of molecules having a cross sectional area larger than that of n-paraffin. In the determination, as disclosed in the same reference, n-hexane and 3-methylpentane are adsorbed by zeolite under certain conditions and the index is calculated from adsorbed quantities. Typical values of the constraint indexes are as follows:

| Catalyst | Constraint Index |
|---|---|
| ZSM-5 | 8.3 |
| ZSM-11 | 8.7 |
| ZSM-35 | 4.5 |
| Amorphous Silica-Alumina | 0.6 |

The method for preparing zeolite used in the present invention will be described with reference to the synthesis of ZSM-5.

In the first place, a starting mixture containing tetrapropylammonium hydroxide or tetra-n-propylammonium bromide, sodium oxide, aluminum oxide, silicon oxide and water, is prepared. The composition may be made within the range as described in the foregoing reference. The reaction mixture is then subjected to hydrothermal synthesis by heating. After the synthesis, the obtained crystal is baked in the air to obtain ZSM-5 zeolite catalyst. Aluminum oxide is used herein, however, it is also proposed to synthesize ZSM-5 called as silicalite containing substantially no aluminum atom. In the above method, tetrapropylammonium hydroxide or tetra-n-propylammonium bromide is used, however, it is also proposed as the method for synthesizing ZSM-5 to use several other organic cations or organic compounds as their precursors in place of them. Such compounds are exemplified by ammonia, trialkylmethylammonium cation, triethyl-n-propylammonium cation, $C_2$ to $C_9$ primary monoalkylamines, neopentylamine, di- and trialkylamines, alkanolamine, $C_5$ to $C_6$ alkyldiamines, $C_3$ to $C_{12}$ alkylenediamines, ethylenediamine, hexamethylenediamine, $C_3$ to $C_6$ diols, ethylene or propylene glycol, 1,4-dimethoxycyclohexane, hydroquinone, ethylene oxide and ammonia, n-dodecylbenzene sulfonate, cyclopentadienyl phthalocyanine complex, 2-aminopyridine, ethylene glycol dimethyl ether, dioxane, dioxolan, tetrahydrofuran, and carboxylic acids such as tartaric acid.

Furthermore, it is also proposed that, without adding organic cations or organic compounds as the precursor thereof as described above, ZSM-5 is added as seeds in crystallization.

The zeolite used for the reaction contains metallic ions such as sodium ions which come from the reaction materials in synthesis. Besides the alkali metal such as sodium, it is possible to used the ones which are ion exchanged by other metals of alkaline earth metals such as calcium and magnesium and other trivalent metallic ions. Furthermore, crystalline synthetic aluminosilicate zeolite such as ZSM-5 type zeolite which is modified by impregnating it with magnesium, boron, potassium, phosphorus or their compounds, can also be used. The methods for these ion exchange and modification can be carried out according to conventional art.

As described above, the crystalline synthetic zeolite of the present invention can contain various kinds of metals. However, the synthetic zeolite which is desirable for the method of the present invention is the so-called hydrogen-type zeolite (HZSM-5) or acid-type zeolite in which the metallic ions are substituted with hydrogen ions. Typical hydrogen-type zeolite is prepared by a process such that the catalyst containing the organic cations used in the catalyst preparation is heated for instance at about 540° C. for 1 hour in an inert atmosphere and it is then subjected to ion exchange with an ammonium salt or a mineral acid such as hydrochloric acid, and it is then baked, for example, at about 540° C. to be activated, thereby obtaining the what is called hydrogen-type zeolite.

If desired, the zeolite may be further subjected to steam treatment or coking treatment.

In batchwise reaction, the reaction time is in the range of 0.5 to 50 hours which is varied according to reaction temperature and other reaction conditions. If the reaction time is shorter than this range, the ratio of reaction is lowered. On the other hand, if the reaction time is too long, it is not desirable because side reaction increases.

When the type of reaction is continuous, the value of LHSV is 0.2 to 20, preferably 0.5 to 10. When the LHSV is smaller than this range, it is undesirable because side reaction increases and the yield per unit time length is lowered. Meanwhile, if the LHSV value is too large, it is not desirable because reactants are discharged out of the reaction system before the reaction proceeds.

The addition quantity cf alkylbenzene may vary with the composition of by-product oil fraction or else. Generally, the molar ratio of alkyl groups of alkylbenzene to diphenylmethane is 0.5 to 20, preferably 1 to 10. When the molar ratio is smaller or larger than this range, it is not desirable because the object of the present invention to lower the point of crystallizing out cannot be attained.

By the contact according to the present invention, the content of diphenylmethane in the raw material is decreased. Therefore, the elimination by distillation of diphenylmethane which is not desirable for the improvement in low temperature characteristics can be made easy.

After the reaction, the unreacted alkylbenzene is removed from the reaction mixture by distillation to obtain a fraction containing 1,1-diphenylethane and containing mainly components having a boiling point in the range of 270° to 300° C. as atmospheric pressure basis. The component below 270° C. in boiling point is not desirable because diphenylmethane is contained which makes the low temperature characteristics worse. On the other hand, the components above 300° C. in boiling point is not desirable either because they raise viscosity and the freezing points of contained compounds are not always low.

The fraction obtained by the method of the present invention does not contain diphenylmethane substantially but it contains unreacted 1,1-diphenylethane and other diarylalkanes which are produced in the method of the present invention. Accordingly, owing to the synergistic effect produced among these components, an electrical insulating oil having excellent low temperature characteristics can be obtained.

The electrical insulating oil prepared according to the method of the present invention is useful as an impregnating oil for various oil-impregnated appliances, especially for oil-filled capacitors. Above all, the insulating oil of the invention is suitable for impregnating oil-filled capacitors in which at least a part of insulating materials or dielectric materials is made of a plastic film. As the plastic materials for the plastic films, polyolefins such as polypropylene and polyethylene as well as polyester and polyvinylidene fluoride are used. Among them, the polyolefin such as polypropylene is especially suitable. The oil-filled capacitors which are suitably impregnated with the electrical insulating oil of the present invention are prepared by winding a metal foil made of, for example, aluminum and together with the above described plastic film as an insulating material or dielectric material, and then impregnating them with the insulating oil. Otherwise, a metallized plastic film is prepared by coating the above plastic film as an insulating material or dielectric material by vacuum evaporation coating of an electro-conductive metal such as aluminum or zinc. The metallized film is then wound, if necessary, together with another plastic film or insulating paper, which is followed by impregnation with the insulating oil to obtain oil-filled capacitors. Incidentally, when the insulating oil of the present invention is used, it is possible to blend proper quantities of conventionally known electrical insulating oils such as phenylxylylethane, alkylbiphenyl, alkylnaphthalene and 1,1-diphenylethylene.

In the conventional art, the by-product oil fraction obtained in the preparation of ethylbenzene has not always been used effectively because it contains diphenylmethane having a high freezing point. However, according to the method of the present invention, it has been made possible to obtain from it a useful fraction as an electrical insulating oil which has excellent low temperature characteristics.

The fraction prepared according to the method of the present invention does not contain diphenylmethane substantially. However, the fraction contains unreacted 1,1-diphenylethane and other diarylalkanes which are formed in the method of the present invention, and owing to the synergistic effect among these components, an electrical insulating oil having excellent low temperature characteristics can be obtained.

For example, when the reaction of the present invention is traced with using an inorganic solid catalyst of silica-alumina, the degree of improvement in the low temperature characteristics is small. When zeolite Y is used, the result is similar. Friedel-Crafts catalysts such as aluminum chloride are not desirable because heavier components are by-produced in large quantities.

In the following, the present invention will be described with reference to examples.

EXAMPLE 1

Preparation of Electrical Insulating Oils

Benzene was alkylated with ethylene in the presence of a ZSM-5 synthetic zeolite catalyst to obtain an alkylation product. This was subjected to elaborate rectification under reduced pressure disregarding economy to obtain a fraction of 270° to 275° C. in boiling point (as atmospheric pressure basis) containing substantially no diphenylmethane. This fraction is hereinafter referred to as "Fraction A".

Separately from the preparation of Fraction A, the alkylation product was subjected to ordinary distillation under reduced pressure to obtain a by-product oil fraction mainly containing components of 260° to 275° C. in boiling point (as atmospheric pressure basis) and containing diphenylmethane and 1,1-diphenylethane. This fraction is hereinafter referred to as "Fraction B". The content of 1,1-diphenylethane in Fraction B was 10 wt. % relative to diphenylmethane.

Meanwhile, to a 250 ml reaction vessel was fed 200 ml of hydrogen-type ZSM-5 catalyst (12 to 14 mesh) which was prepared according to the method described in the foregoing U.S. patent specification and it was dried at 480° C. with feeding dry nitrogen for 3 hours.

A mixture of Fraction B and toluene (50:50) was fed into this reaction vessel at LHSV of 1.0, temperature of 270° C., and pressure of 20 atm (ca. 20 bar) under nitrogen atmosphere.

After the treatment, by ordinary reduced pressure distillation, a lighter fraction containing unreacted toluene was distilled off from the treated mixture to obtain a fraction mainly containing components of 270° to 300° C. in boiling point (as atmospheric pressure basis). This fraction is hereinafter referred to as "Fraction C".

Even though the boiling point of Fraction B as a raw material was 260° to 275° C., high-boiling components were contained in Fraction C which was obtained after treatment with toluene. As a matter of course, this high-boiling components were produced in this contact process.

For comparison purpose, a fraction of 260° to 300° C. in boiling point (as atmospheric pressure basis) containing diphenylmethane was obtained from the above reaction mixture. This fraction is referred to as "Fraction D".

Test on Freezing Points

The freezing points of Fraction B and Fraction C were determined. In the determination, the test liquids were put into test tubes and, at each test temperature, they were aged for 1 week in a temperature cycle of 10° C. above the test temperature in the daytime and 10° C. below the test temperature in the nighttime. After that, the test samples were left to stand still for 1 week at the test temperature. The freezing point was determined at the temperature at which the whole of the contents in a test tube were regarded as solidified by observing with the naked eye. The results are shown in the following Table 1.

TABLE 1

| Fraction | Freezing Point |
|---|---|
| Before Contacting (Fraction B) | −20° C. |
| After Contacting (Fraction C) | Below −40° C. |

Break Down Test

Two sheets of biaxially oriented polypropylene films of 14 micron in thickness were put together one over the other and they were wound together with an electrode of aluminum foil to make model capacitors of 0.4 μF in capacity.

The 4 kinds of Fractions A, B, C and D were respectively impregnated into the model capacitors. The thus prepared model capacitors were cooled for 1 week in a temperature cycle of −40° C. in the daytime and −50° C. in the nighttime. After that, the model capacitors were left to stand still for 1 week at −40° C. and they were used for the break down test.

Ten pieces of model capacitors which were impregnated with the same insulating oil were applied with electric voltage at −40° C. and the electric voltage was raised with a potential gradient of 10 V/μ. The number of broken-down capacitors at each potential gradient value was counted, the results of which are shown in the following Table 2. From the following Table 2, it will be apparently understood that the electrical insulating oil according to the present invention is extremely good.

TABLE 2

| | Potential Gradient (V/μ) | | | | | | | |
|---|---|---|---|---|---|---|---|---|
| Fraction | 40 | 50 | 60 | 70 | 80 | 90 | 100 | 110 |
| Fraction A | 7 | 3 | — | — | — | — | — | — |
| Fraction B | 8 | 2 | — | — | — | — | — | — |
| Fraction C | — | — | — | — | — | — | 1 | 4 |
| Fraction D | — | — | — | — | — | 1 | 2 | 5 |

What is claimed is:

1. An electrical insulating oil which mainly comprises a fraction having excellent low temperature characteristics, said fraction being prepared by bringing a by-product oil fraction containing diphenylmethane and 1,1-diphenylethane into contact with alkylbenzenes having at least one alkyl group of 1 to 4 carbon atoms in the presence of a ZSM-5 type synthetic zeolite catalyst in a temperature range of 180° to 400° C., then recovering from the treated mixture a fraction containing 1,1-diphenylethane and other diarylalkanes and containing mainly components having boiling points in the range of 270° to 300° C. as atmospheric pressure basis, said by-product oil fraction being by-produced in the preparation of ethylbenzene by alkylating benzene with ethylene in the presence of a synthetic zeolite catalyst.

2. The electrical insulating oil in claim 1, wherein said alkylbenzene is toluene.

3. The electrical insulating oil in claim 1, wherein said ZSM-5 type synthetic zeolite is a ZSM-5 zeolite.

4. The electrical insulating oil in claim 1, wherein said synthetic zeolite catalyst in ethylbenzene preparation is a ZSM-5 type synthetic zeolite catalyst.

5. The electrical insulating oil in claim 1, wherein the content of 1,1-diphenylethane in said by-product oil fraction is up to 50% by weight relative to the quantity of diphenylmethane.

6. The electrical insulating oil in claim 1, wherein a molar ratio of alkyl groups of said alkylbenzene to said diphenylmethane is 0.5 to 20.

7. An oil-impregnated appliance which is impregnated with the electrical insulating oil according to claim 1.

8. The oil-impregnated appliance in claim 7, wherein at least a part of insulating material or dielectric material is made of a plastic film.

9. The oil-impregnated appliance in claim 8, wherein said plastic film is polyolefin film.

10. The oil-impregnated appliance in claim 9, wherein said polyolefin is polypropylene.

11. The oil-impregnated appliance in claim 7, wherein said oil-impregnated appliance is an oil-impregnated capacitor.

* * * * *